US006353941B1

(12) United States Patent
Manning et al.

(10) Patent No.: US 6,353,941 B1
(45) Date of Patent: Mar. 12, 2002

(54) STARLING POTTY

(76) Inventors: Katharine C. Manning; Winston Chou, both of 387 Marlborough St., #10, Boston, MA (US) 02115

( * ) Notice: Subject to any disclaimer, the term of this patent is extended or adjusted under 35 U.S.C. 154(b) by 0 days.

(21) Appl. No.: 09/666,350

(22) Filed: Sep. 21, 2000

Related U.S. Application Data

(60) Provisional application No. 60/155,059, filed on Sep. 21, 1999.

(51) Int. Cl.[7] ..... A47K 13/00
(52) U.S. Cl. ..... 4/239; 4/902
(58) Field of Search ..... 4/239, 237, 902

(56) References Cited

U.S. PATENT DOCUMENTS

| | | | | | |
|---|---|---|---|---|---|
| 182,232 | A | * | 9/1876 | Schwartzwald | 4/239 |
| 2,380,102 | A | * | 7/1945 | Farmer | 4/239 |
| 2,454,199 | A | * | 11/1948 | Perrin | 4/239 |
| 2,682,914 | A | * | 7/1954 | Wing | 4/239 |
| 3,343,179 | A | * | 9/1967 | Sellars, Jr. et al. | 4/239 |
| 3,364,505 | A | * | 1/1968 | Palmier | 4/239 |
| 4,133,061 | A | * | 1/1979 | Hurd | 4/239 |
| D305,793 | S | | 1/1990 | Cronk | |
| 5,005,223 | A | | 4/1991 | Greenwood | |
| 5,524,295 | A | | 6/1996 | Ford | |
| 5,765,236 | A | * | 6/1998 | Bethanis | 4/237 |

* cited by examiner

*Primary Examiner*—Charles R. Eloshway
(74) *Attorney, Agent, or Firm*—James Creighton Wray; Meera P. Narasimhan

(57) ABSTRACT

The child's light weight portable toilet seat is designed to be used on top of a standard, commercial adult toilet seat and to provide a safe, stable, ergonomic seating area. The seat is slim, small and light enough to be carried by a child of toilet-training age. It has also been test fitted and may be used on many types of adult toilet seats, including those used in airplanes and boats, for true portability. The seat is molded from a single piece of plastic and has a formed bottom surface which is free of ribs and edges that could catch dirt. The lack of hinges or folds in the seat precludes pinching of the child's skin and reduces potential structural weakness. The absence of cleats or clips makes installation easy for either child or adult. The lack of ribs and edges on the bottom makes the seat more sanitary than existing seats. The seat fits over the front portion of the adult seat rather than being centered over the bowl and, thus, is a more ergonomic seating position for a child.

16 Claims, 2 Drawing Sheets

STARLING POTTY

BACKGROUND OF THE INVENTION

This application claims the benefit of U.S. Provisional Application No. 60/155,059, filed Sep. 21, 1999.

Portable children's toilet seats exist that are designed to be used on top of standard commercial adult toilet seats. However, existing seats have disadvantages of either having hinges or folds, of having cleats or clips, of having ribs or edges on the bottom surface, or of being centered over the bowl. Hinges or folds in the seat can pinch a child's skin and are points of structural weakness. Cleats or clips make installation difficult for adults and nearly impossible for a child. Ribs and edges on the bottom surface catch dirt. Centering of the seat over the bowl is not as ergonomic as in the proposed seat design. Also, existing seats are large, heavy and not easily portable. Needs exist for improved children's toilet seats.

SUMMARY OF THE INVENTION

The invention is a child's light weight portable toilet seat. The seat is designed to be used on top of a standard, commercial adult toilet seat and to provide a safe, stable, ergonomic seating area. The seat is slim, small and light enough to be carried by a child of toilet-training age. It has also been test fitted and may be used on many types of adult toilet seats, including those used in airplanes and boats, for true portability.

The seat is molded from a single piece of plastic and has a formed bottom surface which is free of ribs and edges that could catch dirt. The lack of hinges or folds in the seat precludes pinching of the child's skin and reduces potential structural weakness. The absence of cleats or clips makes installation easy for either child or adult. The lack of ribs and edges on the bottom makes the seat more sanitary than existing seats. The seat fits over the front portion of the adult seat rather than being centered over the bowl and, thus, is a more ergonomic seating position for a child.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
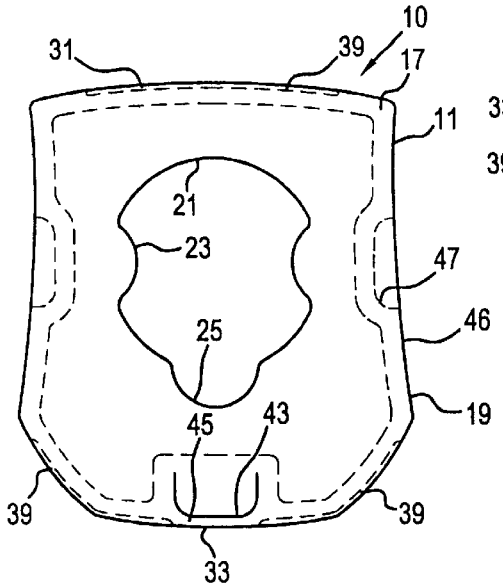
FIG. 1 shows a top view of the portable child toilet seat.
Figure 2:
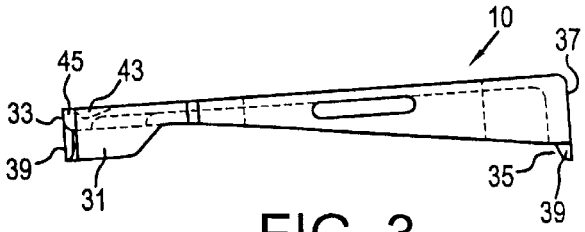
FIG. 2 shows a side view of the portable child toilet seat.
Figure 3:
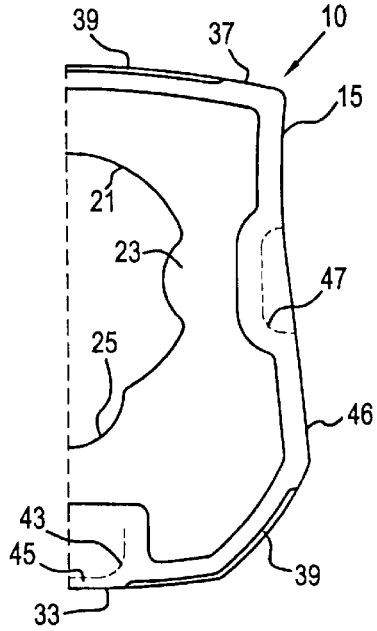
FIG. 3 shows one half of a bottom view of the portable child toilet seat.

The child seat 10 has a flat upper surface and an overall wedge form with the rear of the seat being thicker than the front of the seat. FIG. 1 shows the top 11 of the child seat. FIGS. 2 and 3 show the side 13 and half of the bottom 15 of the seat, respectively. Seat 10 is preferably made of a tough relatively rigid plastic, for example, polypropylene or polystyrene which may be fiber reinforced. Parts of the seat 10 that contact a standard toilet seat have a slip preventing soft, elastomer plastic, preferably molded as a second shot with the main seat 10. Alternatively, elastomer strips may be bonded to the main seat.

The taller rear surface 17 provides structure to span the toilet seat opening and allows the child to sit forward on the toilet, so that the child can sit properly with the child's shins vertical rather than lifted upward and pointed outward. The child seat sides 19 have a slight hour-glass shape, which allows the child seat to fit more properly to the slight valley formed in adult toilet seats. The opening 21 is shaped to provide proper support for the child's weight when in use. The small semi-circular lateral extensions 23 into the opening are positioned under key points in the skeletal structure of the child. As the child sits, these lateral extensions help maintain the child's bottom spread open. A forward extension 25 of the opening 21 is provided for access or to mount a shield.

FIG. 2 shows the side view of the portable toilet seat. Three downward pointing extended tabs, tabs 31 at the front 33, and tab 35, at the rear 37, position and hold the child's seat 10 in its proper position on the adult seat. Continuous strips 39 of elastomer, a softer, rubbery plastic, attached as part of the second shot molding process, or bonded to the tab surfaces prevent slippage. The tabs 31 and 35 fit downward within the toilet seat opening. The recesses in the tabs 31 and 35 are filled with the elastomer strips 39 to engage the inner edges of the toilet seat openings for stability.

A removable cup is provided for boys. Installed, this cup can flip down for portability. The forward and downward sloping upper face has a recess 43 at the front to hold a toy or other device within reach of the seated child. The recess is used as a grip to place and remove the child's seat. The recess 43 also provides a handle 45 to assist in inserting the seat into and withdrawing the seat from a backpack. The side walls 46 have recesses 47 which form handles for lifting and placing the child seat and for holding by a child when seated.

Figure 5:
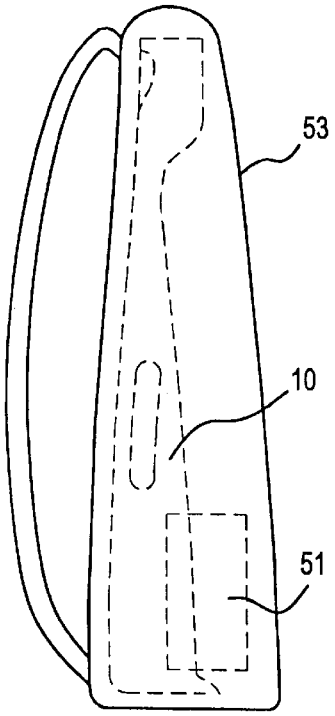
FIG. 5 shows a side view of the backpack with the seat and wipes enclosed within the backpack.
Figure 4:
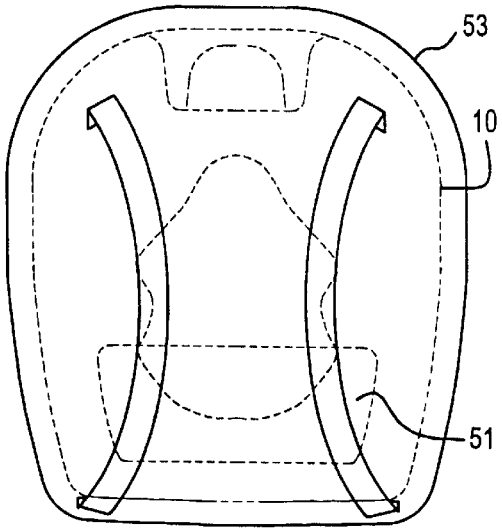
FIG. 4 shows a back view of the backpack with the seat and wipes enclosed within the backpack.
Figure 6:
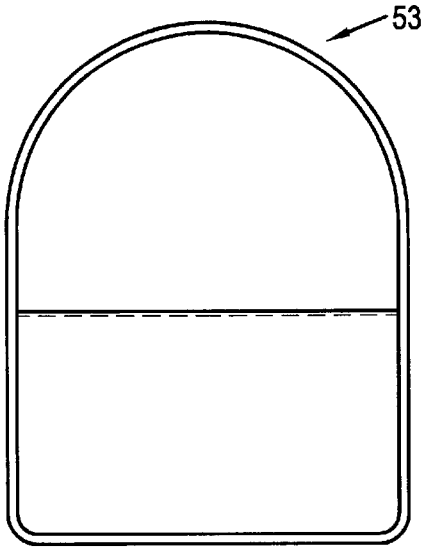
FIG. 6 shows a front view of the backpack for the portable child toilet seat.
Figure 7:
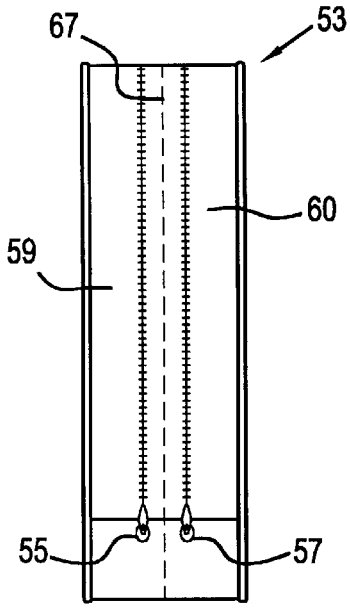
FIG. 7 shows a side view of the backpack for the portable child toilet seat.
Figure 8:
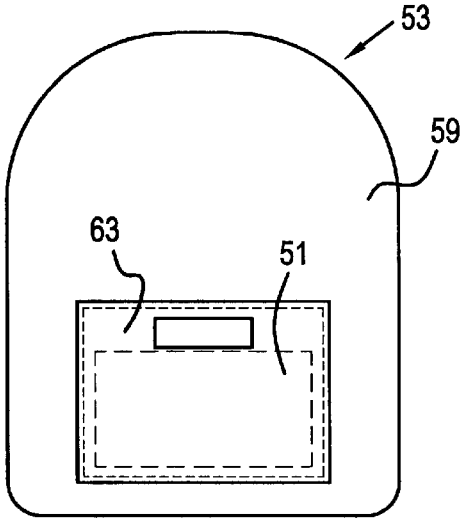
FIG. 8 shows an inside view of the back compartment of the backpack facing the front of the backpack.
Figure 9:
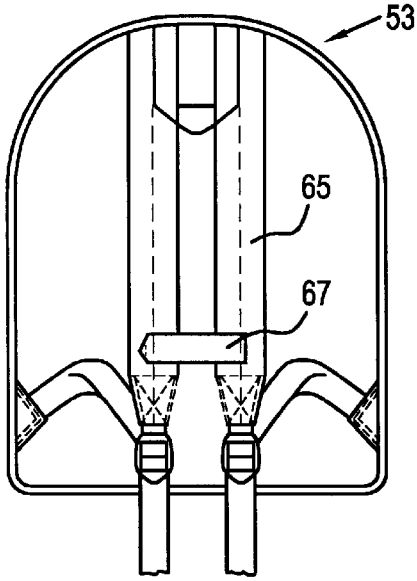
FIG. 9 shows a back view of the backpack for the portable child toilet seat.

The child's seat 10 is packaged with cleaning wipes 51 in a backpack 53, so the child is encouraged to carry the seat. FIGS. 4 and 5 show back and side views of the backpack with the seat 10 and wipes 51 enclosed within the backpack. FIGS. 6, 7, 8, and 9 show the front, side, inside-back-compartment (looking toward the front of the backpack from the back of the backpack), and back views, respectively, of the backpack 53. The backpack 53 is made of 100% PVC and has ¼ inch seams bound in ¾ inch plastic and ⅛ inch piping for edging. The backpack has two plastic slide fastening Zippers 54 and 56 with pull tabs 55 and 57 which open the slide fasteners to two completely separate compartments 59 and 60 separated by a partition 61. The back compartment 59 contains a velcro inside pocket 63. The back compartment 59 contains the child seat 10 in the main back compartment and wipes 51 in the velcro inner pocket 63 while the front compartment 60 is for toys. The shoulder straps 65 are made of nylon, are one inch wide, have internal padding, and have plastic buckles at the bottom. Another unique feature of the backpack 53 is that it has a horizontal strap 67 with velcro across the lower area of the shoulder straps. The horizontal strap 67 is used to adjust the size and fit of the backpack 53 on the toddler.

The graphics of the seat 10 and backpack 53 match one another and give a child-friendly presentation. Ownership of the seat is the child's, as part of the psychology involved in toilet training. The child will be more involved as an active participant in the care and use of the seat.

The seat has been test fitted on all types of adult seats including those used in airplanes and boats. Thus, the seat allows for a continuous toilet training process, unbroken by airplane trips, restaurant meals, and other outings when diapers are usually used as a temporary solution.

While the invention has been described with reference to specific embodiments, modifications and variations of the invention may be constructed without departing from the scope of the invention, which is defined in the following claims.

We claim:

1. A child's toilet seat comprising a sloped upper seating surface with a tall back and a relatively short front and having at least one tab extending around a lower part of the back for fitting within an opening in a commercial toilet seat and having first and second tabs extending downward from the front of the child's toilet seat for fitting within the front of an opening of a commercial toilet seat, the child's toilet seat having generally triangular sides which centrally curve inward in a slightly hour-glass shape, recesses in centers of the sides for forming side handles and a generally arcuate opening in the center of the upper seating surface for communicating with a toilet, the generally arcuate opening having an arcuate rear edge and arcuate inward lateral extensions near lateral centers of the generally arcuate opening for holding a child's bottom, the arcuate opening having a forward extending arcuate opening.

2. The child's toilet seat apparatus of claim 1, further comprising a recess in the upper surface at the front of the toilet seat for holding toys, for providing a finger grip and for operating as a handle for placing the child's toilet seat on a commercial toilet seat.

3. The child's toilet seat apparatus of claim 1, further comprising recesses in the tabs and soft frictional material in the recesses for preventing the child's toilet seat from sliding on a commercial toilet seat.

4. The child's toilet seat apparatus of claim 1, further comprising soft rubbery layers on outer surfaces of the tabs and on lower surfaces of the sides and front for preventing movement of the child's toilet seat on a commercial toilet seat.

5. The apparatus of claim 1, further comprising a backpack having a shoulder strap and an internal compartment for holding the child's toilet seat, the child's toilet seat disposed in the internal compartment of the backpack and a handle on the child's toilet seat for removing the child's toilet seat from the backpack and for placing the child's toilet seat on a commercial toilet seat of an available toilet.

6. The apparatus of claim 5, wherein the backpack has first and second shoulder straps attached to the backpack.

7. The apparatus of claim 6, wherein the backpack is sized according to a child's back so that a child may carry the child's toilet seat in the backpack.

8. The apparatus of claim 6, wherein the backpack has first and second compartments separated by a vertical partition, the backpack compartment nearest the shoulder straps having an access for inserting and removing the child's toilet seat and having a slide fastening closure surrounding the access.

9. The apparatus of claim 8, further comprising a pocket in the first compartment for carrying wipes.

10. A child's toilet seat for placing on top of a commercial toilet seat comprising a frame having side members and a front member for resting on top of side and front portions of commercial toilet seats and having a rear member for extending between rear ends of the side members and supporting the frame, a seat panel extending between the side members and the front and rear members, the child's toilet seat having a relatively tall back and a relatively short front and generally triangular shaped sides for sloping the upper surface forward, the upper surface having a generally arcuate opening in its center with an arcuate rear portion and inward extending arcuate side portions for engaging a child's bottom and a sharply arcuate forward portion for access or holding a deflector, the side members having recesses for forming finger openings for handles in the sides and the front portion of the upper surface having a depression for providing a finger opening for lowering the child's toilet seat onto a commercial seat and for lifting the child's toilet seat from the commercial seat and further comprising tabs extending downward from intersections of the front and side members and extending downward from the rear edge and intersections of the rear end side members for positioning the tabs within an opening in a commercial toilet seat and preventing movement of the child's toilet seat.

11. The child's toilet seat apparatus of claim 10, further comprising recesses in the tabs and soft frictional material in the recesses for preventing movement of the child's toilet seat on a commercial toilet seat.

12. The child's toilet seat apparatus of claim 10, further comprising soft rubbery layers on outer surfaces of the tabs for preventing movement of the child's toilet seat on the commercial toilet seat.

13. The child's toilet seat apparatus of claim 10, wherein the side members are generally curved with inward portions near the inward curving portions of the central opening.

14. The child's toilet seat apparatus of claim 10, further comprising soft plastic friction strips formed on lower surfaces of the side members and on outer surfaces of the tabs.

15. The child's toilet seat apparatus of claim 14, further comprising a backpack having a first inner compartment for receiving the child's toilet seat and having outer fabric covers and shoulder straps attached to one major surface of the backpack.

16. The apparatus of claim 10, further comprising a backpack having a shoulder strap and an internal compartment for holding the child's toilet seat, the child's toilet seat disposed in the internal compartment of the backpack.

* * * * *